US009146530B2

(12) United States Patent
Seto et al.

(10) Patent No.: US 9,146,530 B2
(45) Date of Patent: Sep. 29, 2015

(54) IMAGE FORMING APPARATUS HAVING A MOVABLE CONNECTOR

(71) Applicant: CANON KABUSHIKI KAISHA, Tokyo (JP)

(72) Inventors: Masaki Seto, Gotemba (JP); Tamotsu Kaneko, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/102,064

(22) Filed: Dec. 10, 2013

(65) Prior Publication Data

US 2014/0169824 A1 Jun. 19, 2014

(30) Foreign Application Priority Data

Dec. 13, 2012 (JP) ..... 2012-272620

(51) Int. Cl.
*G03G 21/18* (2006.01)
*G03G 21/16* (2006.01)

(52) U.S. Cl.
CPC ..... *G03G 21/1652* (2013.01); *G03G 21/185* (2013.01); *G03G 21/1871* (2013.01)

(58) Field of Classification Search
CPC ..... G03G 21/1652; G03G 21/185; G03G 21/1867; G03G 21/1871; G03G 21/1878; G03G 21/1885; G03G 15/80; G03G 2221/166; G03G 2221/1823
USPC ..... 399/90, 110, 111, 262
See application file for complete search history.

(56) References Cited

U.S. PATENT DOCUMENTS

| | | | | |
|---|---|---|---|---|
| 5,937,239 | A | 8/1999 | Watanabe | |
| 7,433,622 | B2 * | 10/2008 | Chadani et al. | 399/90 |
| 2003/0123896 | A1 | 7/2003 | Goto | |
| 2013/0114971 | A1 * | 5/2013 | Sasaki et al. | 399/90 |
| 2014/0086597 | A1 * | 3/2014 | Tanabe et al. | 399/111 X |

* cited by examiner

*Primary Examiner* — Sophia S Chen
(74) *Attorney, Agent, or Firm* — Canon USA, Inc., IP Division

(57) ABSTRACT

Provided is an image forming apparatus including an apparatus electric-contact that is connectable to a cartridge electric-contact of a cartridge, which is equipped with a memory that stores information related to the cartridge, such that the information is transmitted from the cartridge to a main apparatus body of the image forming apparatus; a connector having the apparatus electric-contact and a first engaging unit that is engageable with the cartridge so as to position the cartridge electric-contact and the apparatus electric-contact in a predetermined direction; and a connector holder that holds the connector in a movable manner. The connector holder has a second engaging unit that is engageable with the cartridge. The connector is movable in the predetermined direction.

21 Claims, 13 Drawing Sheets

IMAGE FORMING APPARATUS HAVING A MOVABLE CONNECTOR

BACKGROUND OF THE INVENTION

1. Field of the Invention

The present invention relates to image forming apparatuses, and particularly, to an image forming apparatus that uses a cartridge equipped with a memory.

2. Description of the Related Art

A known electrophotographic image forming apparatus, which is a kind of an image forming apparatus, uses a process cartridge formed by combining an electrophotographic photosensitive drum and process units into a single cartridge unit. With this process-cartridge method, maintenance of the electrophotographic image forming apparatus can be performed by the user instead of a serviceman. This significantly improves the ease of use. Thus, this process-cartridge method has been widely used in electrophotographic image forming apparatuses.

A known process cartridge (referred to as "cartridge" hereinafter) is equipped with a memory (such as an integrated-circuit (IC) memory) that stores information to be transmitted to the main apparatus body of the electrophotographic image forming apparatus. When the cartridge is inserted in the main apparatus body, information can be exchanged between the main apparatus body and the cartridge. Thus, a controller of the main apparatus body can be notified of the status, such as the usage condition, of the cartridge (see U.S. Pat. No. 5,937,239).

Information, such as the lot number of the cartridge, the characteristics of the image forming apparatus, and the characteristics of the process units, is registered in the memory equipped in the cartridge. This facilitates maintenance of the main apparatus body or the cartridge. Moreover, image forming operation is controlled in accordance with the information stored in the memory so that the image forming operation can be performed under better conditions.

A contact-type electric connection technique is a known technique for electrically connecting the memory equipped in the cartridge of the image forming apparatus to the main apparatus body. In this technique, the memory and the main apparatus body are electrically connected to each other by using a connector or a contact formed of a spring, which have simple configurations and are advantageous in terms of cost (see US Patent Laid-Open No. 2003-0123896).

However, when strong impact force is applied to a positioning boss of the connector due to strong impact force or vibration applied to the main apparatus body during physical distribution, such as during transport, there is a possibility that the boss may break. Even if the connector were to be given a predetermined movable range for compensating for positional variations between the connector and the cartridge, the moving distance of the cartridge, which has a large mass, may exceed that movable range due to the strong impact. In this case, for example, the positioning boss of the connector, which serves as a positioning section for the connector and the cartridge, receives extremely large impact force. As a result, compact engagement sections, such as the positioning boss, may break or deform, possibly causing the connection state between an electric contact of the cartridge and an electric contact of the main apparatus body to deteriorate. On the other hand, expanding the movable range of the connector or increasing the strength of the positioning member would lead to an increase in size of the apparatus electric-contact mechanism.

SUMMARY OF THE INVENTION

The present disclosure provides an image forming apparatus including an apparatus electric-contact, a connector, and a connector holder. The apparatus electric-contact is connectable to a cartridge electric-contact of a cartridge, which is equipped with a memory that stores information related to the cartridge, such that the information is transmitted from the cartridge to a main apparatus body of the image forming apparatus. The connector has the apparatus electric-contact and a first engaging unit that is engageable with the cartridge so as to position the cartridge electric-contact and the apparatus electric-contact in a predetermined direction. The connector holder holds the connector in a movable manner. The connector holder has a second engaging unit that is engageable with the cartridge. The connector is movable in the predetermined direction.

Further features of the present invention will become apparent from the following description of exemplary embodiments with reference to the attached drawings.

DESCRIPTION OF THE EMBODIMENTS

First Embodiment

Configuration of Image Forming Apparatus

Figure 1A:
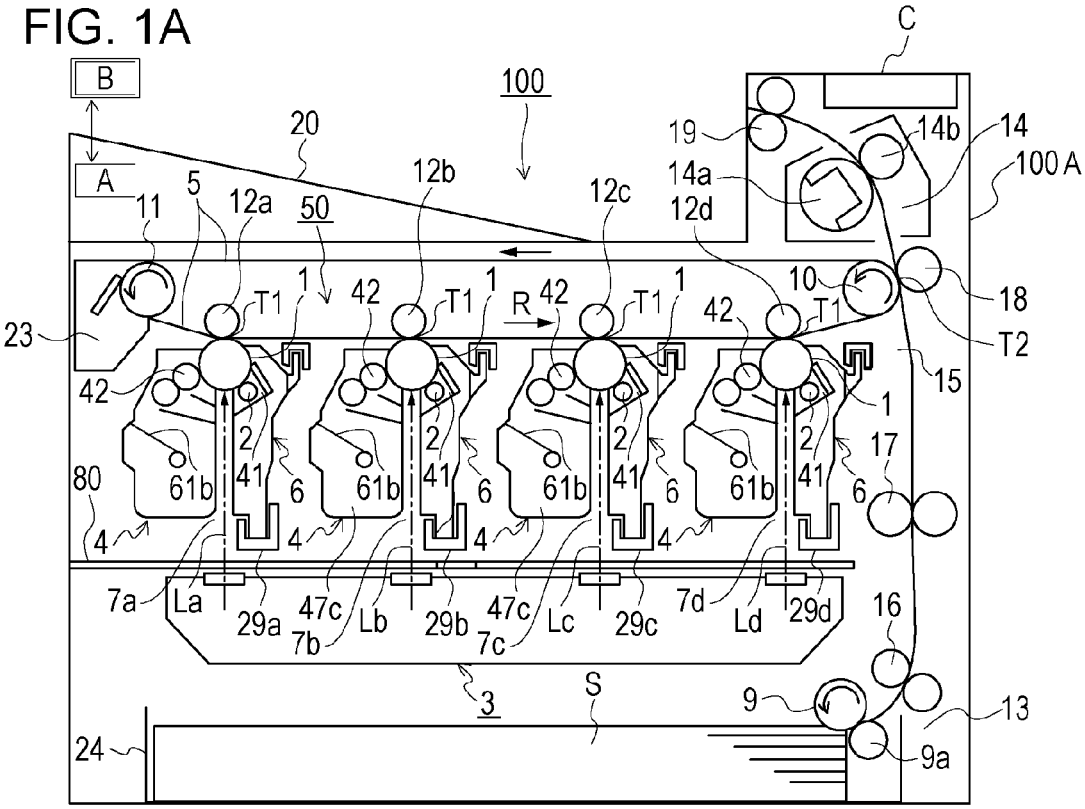
FIGS. 1A and 1B are sectional views illustrating an image forming apparatus according to a first embodiment.
Figure 1B:
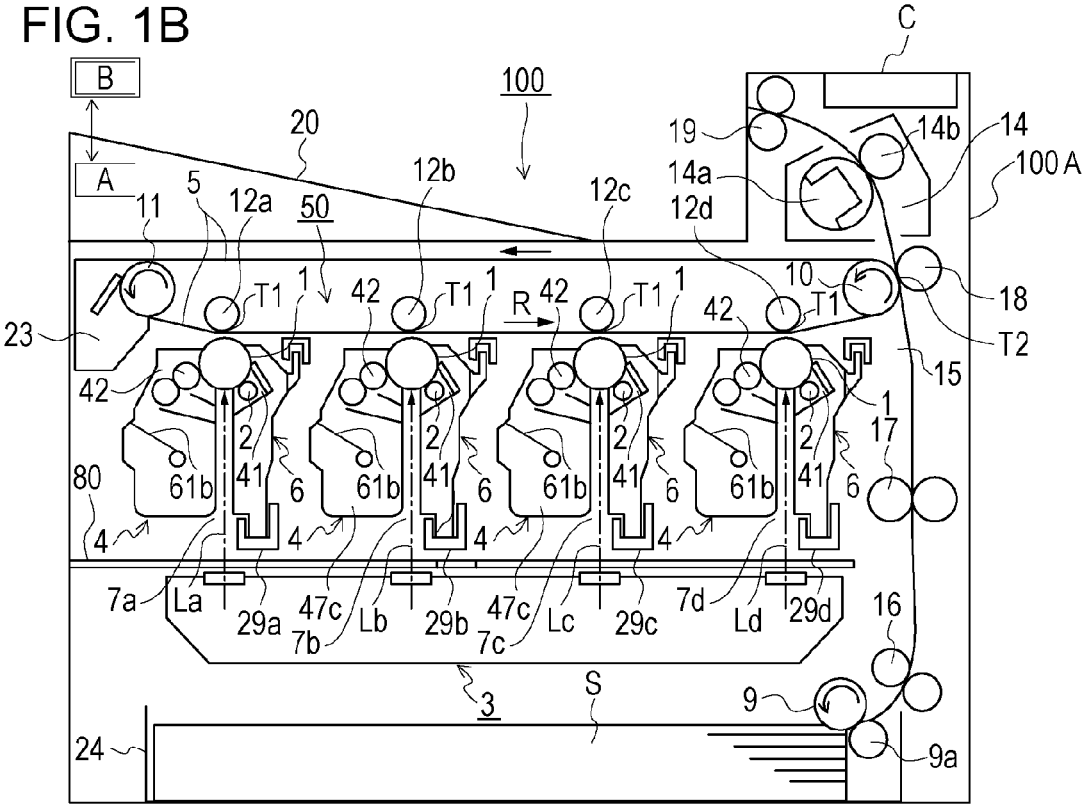
Figure 2A:
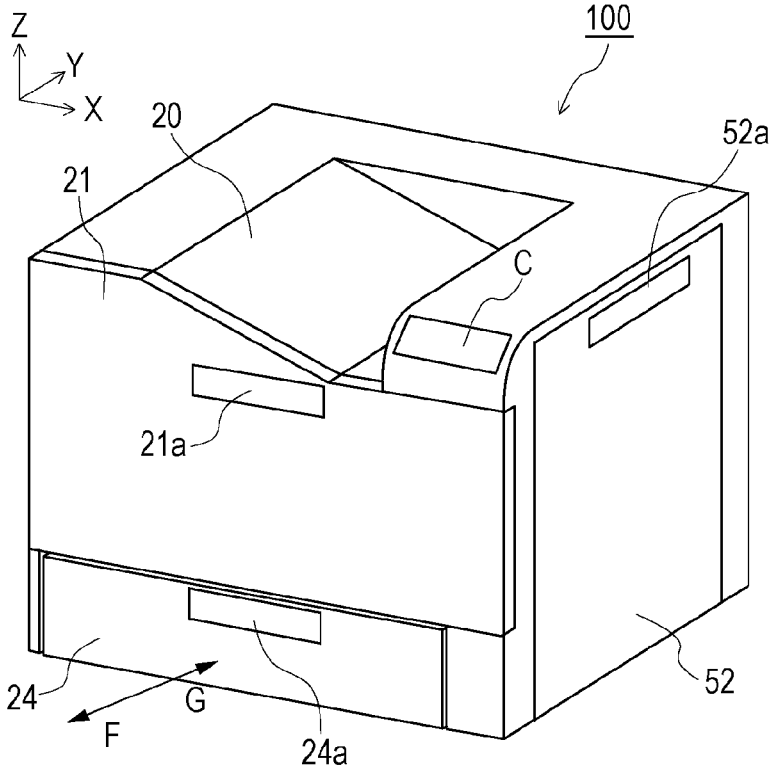
FIGS. 2A and 2B are external perspective views of the image forming apparatus according to the first embodiment.
Figure 2B:
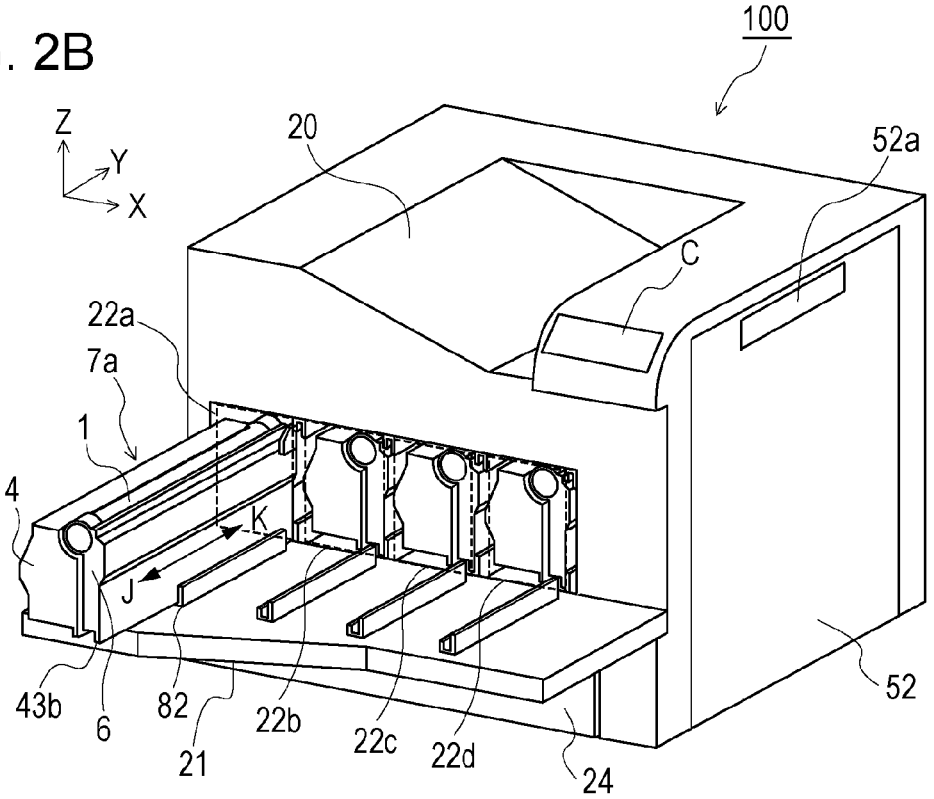

FIGS. 1A and 1B are vertical sectional views schematically illustrating an image forming apparatus 100 according to a first embodiment. Specifically, FIG. 1A is a sectional view illustrating a state where the image forming apparatus 100 is performing image forming operation, and FIG. 1B is a sectional view illustrating a state where a front door 21 for opening and closing a main apparatus body 100A is opened and process cartridges are in a non-image-forming mode. FIGS. 2A and 2B are external perspective views of the image forming apparatus 100. Specifically, FIG. 2A is an external perspective view of the image forming apparatus 100 in a state where the front door 21 is closed, and FIG. 2B illustrates a state where the front door 21 is opened and a first cartridge 7*a* is being inserted into or ejected from the main apparatus body 100A.

The image forming apparatus 100 according to the first embodiment is a four-color (full-color) laser-beam printer (color image forming apparatus) that uses an electrophotographic process. Specifically, the image forming apparatus 100 forms an image onto a sheet-like recording medium S (such as paper, an overhead projector (OHP) sheet, or a label) on the basis of an electrical image signal input to a control circuit A (i.e., a control unit such as a central processing unit (CPU)) from an external host device B, such as a personal computer or an image reader. The control circuit A exchanges various kinds of electrical information between the external host device B and an operable section C and also performs overall control of the image forming operation of the image forming apparatus 100 in accordance with a predetermined control program or a predetermined reference table.

The image forming apparatus 100 is of a type in which multiple cartridges, that is, first to fourth cartridges 7 (7*a* to 7*d*) in the image forming apparatus 100 according to the first embodiment, are mounted in the main apparatus body 100A in a removable manner. By opening the front door 21 of the main apparatus body 100A as in FIG. 2B so as to open the front side of the main apparatus body 100A, the cartridges 7 can be individually removed from cartridge mounting sections 22 within the main apparatus body 100A. The cartridges 7 are inserted into the respective cartridge mounting sections 22 (22*a* to 22*d*) such that the longitudinal direction of the cartridges 7 is set in alignment with the front-rear direction of the main apparatus body 100A. Moreover, the cartridges 7 are positioned at image formable positions in conjunction with a closing of the front door 21.

The cartridges 7 have electrophotographic process mechanisms that are similar to each other. Each cartridge 7 according to the first embodiment has a drum 1, a charging roller (charging unit) 2, a developing unit 4, and a photosensitive unit 6. The charging roller 2, the developing unit 4, and the photosensitive unit 6 serve as process units that perform operation on the drum 1. In the image forming apparatus 100 according to the first embodiment, the first cartridge 7*a* contains a yellow (Y) developer (referred to as "toner" hereinafter) within a toner container of the developing unit 4. The second cartridge 7*b* contains a magenta (M) toner within the toner container of the developing unit 4. The second cartridge 7*c* contains a cyan (C) toner within the toner container of the developing unit 4. The second cartridge 7*d* contains a black (K) toner within the toner container of the developing unit 4.

Each cartridge 7 set at the corresponding image formable position receives rotational driving force from the main apparatus body 100A so that the drum 1 is rotationally driven at a predetermined speed in the clockwise direction. The cartridge 7 is supplied with predetermined bias (such as charging bias or developing bias) from the main apparatus body 100A.

In the main apparatus body 100A, a laser scanner unit 3 serving as an image information exposure unit for the drums 1 of the cartridges 7 is provided below the cartridge mounting sections 22.

Furthermore, in the main apparatus body 100A, an intermediate transfer belt unit 50 is provided above the cartridge mounting sections 22. The intermediate transfer belt unit 50 has a drive roller 10 disposed at the right side, a tension roller 11 disposed at the left side, and an intermediate transfer belt (referred to as "belt" hereinafter) 5 wrapped around the two rollers. The upper surfaces of the drums 1 of the cartridges 7 set at the respective image formable positions are in contact with the lower surface of the lower belt layer of the belt 5. A contact area between each drum 1 and the belt 5 acts as a primary transfer section T1. First to fourth primary transfer rollers 12 (12*a* to 12*d*) that are opposed to the drums 1 of the cartridges 7 with the belt 5 interposed therebetween are arranged at the inner side of the lower belt layer such that the rotational axes of the primary transfer rollers 12 are parallel to the front-rear direction of the main apparatus body 100A. In a state where the lower belt layer of the belt 5 is in contact with the upper surfaces of the drums 1 of the cartridges 7, the belt 5 is rotationally driven by the drive roller 10 in the counterclockwise direction indicated by an arrow R at a speed corresponding to the rotating speed of the drums 1. The primary transfer rollers 12 each receive predetermined primary transfer bias at a predetermined control timing. A secondary transfer roller 18 is disposed at the outer side of a belt bending section of the drive roller 10. A contact area between the belt 5 and the secondary transfer roller 18 acts as a secondary transfer section T2. The secondary transfer roller 18 receives predetermined secondary transfer bias at a predetermined control timing. A transfer-belt cleaning device 23 is disposed at the outer side of a belt bending section of the tension roller 11.

A recording-medium feeder 13 is disposed at a lower section of the main apparatus body 100A. The recording-medium feeder 13 has a feeding cassette 24 that accommodates recording media (transfer media) S, a pair of rollers constituted of a feeding roller 9 and a retardation roller 9*a*, and a pair of conveying rollers 16. A recording-medium conveying unit extending from the recording-medium feeder 13 to the upper section of the main apparatus body 100A is provided at the right side within the main apparatus body 100A. The recording-medium conveying unit is constituted of a pair of registration rollers 17, a conveyance path 15, the secondary transfer section T2, a fixing unit 14, and a pair of discharging rollers 19. The upper surface of the main apparatus body 100A serves as a discharge tray 20.

The feeding cassette 24 is of a front-access type that is inserted into and ejected from the main apparatus body 100A from the front side thereof. The feeding cassette 24 has a handle 24*a*. Specifically, the feeding cassette 24 is ejectable toward the front side of the main apparatus body 100A, as indicated by an arrow F in FIG. 2A, such that a user can remove the feeding cassette 24 from the main apparatus body 100A and set recording media S in the feeding cassette 24. By pressing the feeding cassette 24 in a direction indicated by an arrow G in FIG. 2A so as to insert the feeding cassette 24 into the main apparatus body 100A, resupplying of recording media S is completed.

A right side door 52 is rotatably attached to the right side surface of the main apparatus body 100A. The right side door 52 is rotated by pulling on a handle 52*a* attached to the right side door 52, thereby exposing the conveyance path 15. Thus, when a recording medium S becomes jammed, a work space for removing the jammed recording medium S can be ensured.

The operation for forming a full-color image is as follows. The control circuit A commences image forming operation of the image forming apparatus 100 on the basis of a print start signal. Specifically, the drums 1 of the first to fourth cartridges 7 (7*a* to 7*d*) are rotationally driven in the clockwise direction at a predetermined speed in accordance with an image forming timing. The belt 5 is rotationally driven in the counterclockwise direction indicated by the arrow R (i.e., forward direction relative to the rotation of the drums 1) at a speed corresponding to the speed of the drums 1. The laser scanner unit 3 is also driven. In synchronization with this driving, the surface of the drum 1 in each cartridge 7 is uniformly charged to an electric potential of a predetermined polarity by the charging roller 2 having received predetermined charging bias. The laser scanner unit 3 performs a scan exposure process on the surfaces of the drums 1 by using laser beams L (La, Lb, Lc, and Ld) modulated in accordance with Y, M, C, and K image information signals. The laser beams L are output upward through first to fourth windows 81 (see FIG. 4) provided in an upper plate 80 of the laser scanner unit 3. Each laser beam L (La, Lb, Lc, or Ld) output from the laser scanner unit 3 enters the corresponding cartridge 7 via a lower laser-beam entrance opening 63 (see FIG. 4) so as to be radiated onto the lower surface of the drum 1. Thus, an electrostatic latent image according to the image information signal of the corresponding color is formed on the surface of the drum 1. The formed electrostatic latent image is developed into a toner image by a developing roller 42 of the developing unit 4.

As the result of the electrophotographic image forming process described above, a Y toner image corresponding to a yellow component of the full-color image is formed on the drum 1 of the first cartridge 7*a*, and this toner image is primarily transferred onto the belt 5 at the primary transfer section T1 of the first cartridge 7*a*. Moreover, an M toner image corresponding to a magenta component of the full-color image is formed on the drum 1 of the second cartridge 7*b*, and this toner image is superimposed and primarily transferred onto the Y toner image, already transferred on the belt 5, at the primary transfer section T1 of the second cartridge 7*b*. Furthermore, a C toner image corresponding to a cyan component of the full-color image is formed on the drum 1 of the second cartridge 7*c*, and this toner image is superimposed and primarily transferred onto the Y+M toner images, already transferred on the belt 5, at the primary transfer section T1 of the second cartridge 7*c*. Moreover, a K toner image corresponding to a black component of the full-color image is formed on the drum 1 of the second cartridge 7*d*, and this toner image is superimposed and primarily transferred onto the Y+M+C toner images, already transferred on the belt 5, at the primary transfer section T1 of the second cartridge 7*d*. At a predetermined control timing, each of the first to fourth primary transfer rollers 12 (12*a* to 12*d*) receives predetermined primary transfer bias with a predetermined electric potential that is opposite in polarity from the charge polarity of the corresponding toner.

Accordingly, the Y+M+C+K full-color unfixed toner images are formed on the moving belt 5. As the belt 5 continuously rotates, the unfixed toner images are conveyed to the secondary transfer section T2.

After primarily transferring the toner image onto the belt 5 at each cartridge 7, the primary-transfer residual toner is removed from the surface of the drum 1 by a cleaning member 41 of the photosensitive unit 6, so that the drum 1 can be used for a subsequent image forming process.

On the other hand, one sheet of a recording medium S inside the feeding cassette 24 is fed by the feeding roller 9 and the retardation roller 9*a* at a predetermined control timing and is conveyed to the pair of registration rollers 17 by the pair of conveying rollers 16. The recording medium S is conveyed by the pair of registration rollers 17 at a predetermined control timing to the secondary transfer section T2 via the conveyance path 15. At a predetermined control timing, the secondary transfer roller 18 receives predetermined secondary transfer bias with a predetermined electric potential that is opposite in polarity from the charge polarity of the toners. Thus, while the recording medium S is pinched and conveyed through the secondary transfer section T2, the four-color superimposed toner images on the belt 5 are sequentially and collectively secondarily-transferred onto the surface of the recording medium S. The recording medium S exiting the secondary transfer section T2 becomes separated from the belt 5 and is conveyed to the fixing unit 14. Then, the recording medium S is pinched and conveyed by a fixing nip section serving as a pressure-contact nip section between a fixing member 14*a* and a pressing member 14*b* of the fixing unit 14 so as to receive heat and pressure therefrom, whereby the toner images become fixed onto the recording medium S. The recording medium S exiting the fixing unit 14 is discharged onto the discharge tray 20 by the pair of discharging rollers 19.

After secondarily transferring the toner images onto the recording medium S, the secondary-transfer residual toners remaining on the surface of the belt 5 are removed from the surface of the belt 5 by the transfer-belt cleaning device 23, so that the cleaned surface of the belt 5 can be used for a subsequent image forming process.

The toners removed by the transfer-belt cleaning device 23 travel through a waste-toner conveyance path (not shown) so as to be conveyed and collected into a waste-toner collecting container (not shown) disposed at the rear side of the apparatus.

Configuration of Cartridge

Figure 3:
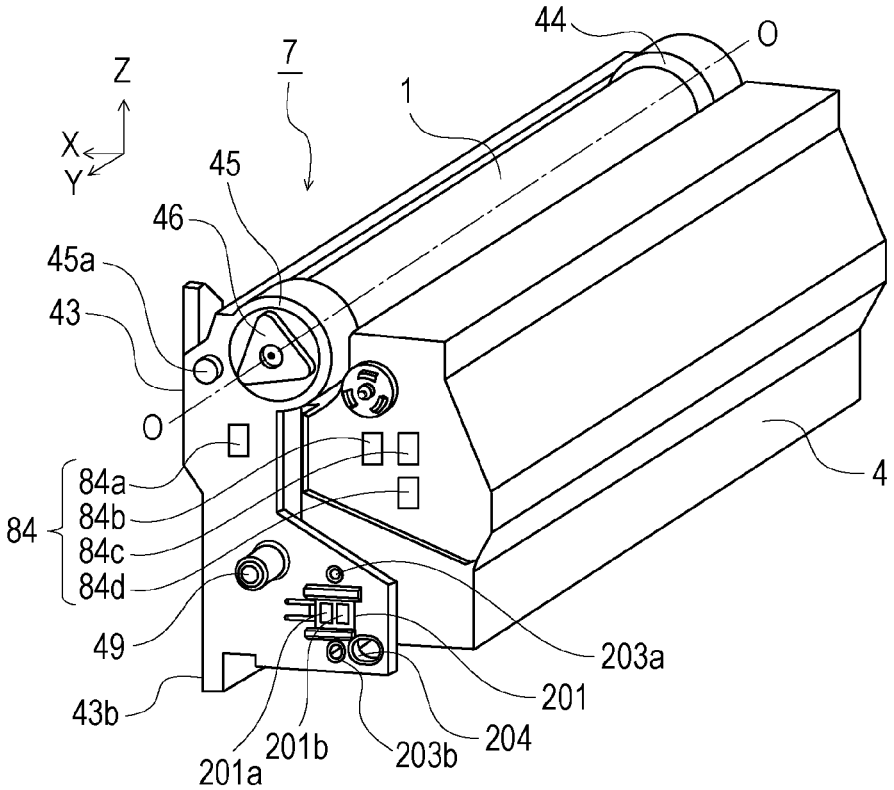
FIG. 3 is a perspective view of one of cartridges to be inserted into the image forming apparatus according to the first embodiment.
Figure 4:
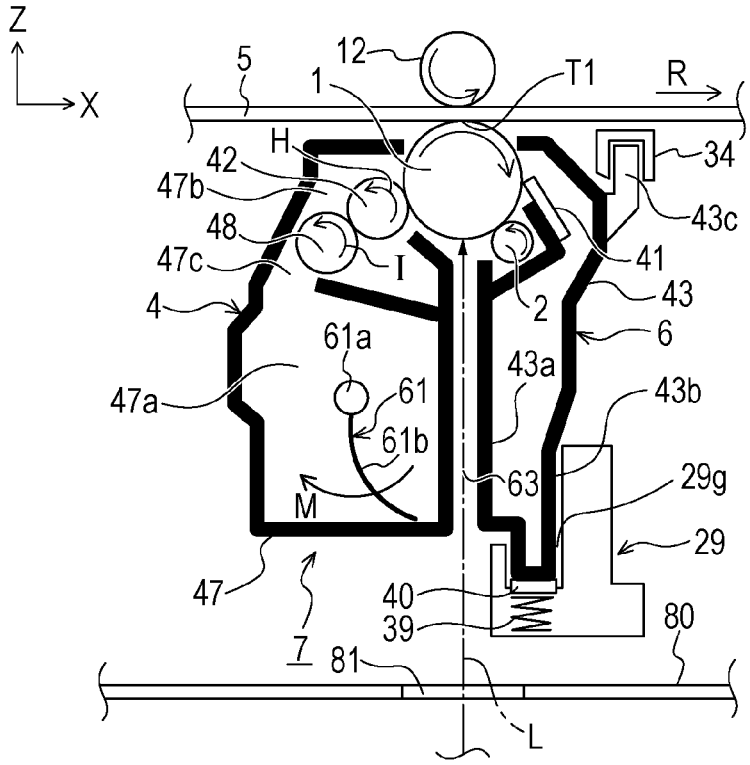
FIG. 4 is a sectional view of the cartridge, a main apparatus body, and a surrounding area of the cartridge, in accordance with the first embodiment.

The cartridges 7 according to the first embodiment will now be described with reference to FIGS. 3 and 4. The first to fourth cartridges 7 (7*a* to 7*d*) have the same configuration except for that the toners contained in the toner containers of the developing units 4 are of Y, M, C, and K colors. FIG. 3 is an external perspective view of one of the cartridges 7, as viewed from the rear side (i.e., drive side) in the inserting direction thereof. FIG. 4 is a partial sectional view of the cartridge 7 set in its image formable position within the main apparatus body 100A and a surrounding area thereof.

The cartridge 7 is an assembly extending longitudinally along a rotational axis O-O (FIG. 3) of the drum 1 and includes the photosensitive unit 6 equipped with, for example, the drum 1, the charging roller 2, and the cleaning member 41, and the developing unit 4 equipped with, for example, the developing roller 42 serving as a developer bearing member (developing member).

The drum 1 is rotatably attached to a cleaning frame 43 of the photosensitive unit 6 via front and rear shaft bearings 44 and 45. The charging roller 2 and the cleaning member 41 are disposed on the periphery of the drum 1. The charging roller 2 is maintained in contact with the drum 1 with a predetermined pressing force and rotates in conjunction with the rotation of the drum 1. The cleaning member 41 is maintained in contact with the drum 1 with a predetermined pressing force. The residual toner removed from the surface of the drum 1 by the cleaning member 41 falls into a removed-toner chamber 43*a*. A rear end of the cleaning frame 43 as viewed in the cartridge inserting direction is provided with a drive input coupling (drive receiving section) 46.

A developing frame 47 of the developing unit 4 is provided with a toner container (developer container) 47*a* and a developing chamber 47*b*. The toner container 47*a* contains a toner serving as a developer. In the developing chamber 47*b*, the developing roller 42 that rotates in a direction indicated by an arrow H by coming into contact with the drum 1 is disposed. The developing chamber 47*b* is disposed above the toner container 47*a*, and the toner container 47*a* and the developing chamber 47*b* communicate with each other via an opening 47*c* located above the toner container 47*a*. A toner supplying roller 48 serving as a developer supplying member that rotates in a direction indicated by an arrow I by coming into contact with the developing roller 42 is disposed on the periphery of the developing roller 42.

The toner container 47*a* is provided with a rotatably-supported toner stirring member 61 that stirs the contained toner and that sends the toner toward the toner supplying roller 48 in the developing chamber 47*b* via the opening 47*c*. The toner stirring member 61 is constituted of a shaft member 61*a* and a flexible plastic stirring sheet 61*b* whose one end is attached to the shaft member 61*a* and provided for stirring and conveying the toner. The toner stirring member 61 is rotationally driven at a predetermined speed in a direction indicated by an arrow M in accordance with image forming operation.

The developing frame 47 of the developing unit 4 is integrally joined to the cleaning frame 43 of the photosensitive unit 6.

A guide rib 43*b* extending in the longitudinal direction of the cleaning frame 43 is formed at the lower section of the cleaning frame 43. The guide rib 43*b* engages with a corresponding one of guide grooves 82 (see FIG. 2B) in the front door 21. A gap between the photosensitive unit 6 and the developing unit 4 acts as a slit opening 63 serving as a laser-beam entrance opening (see FIG. 4).

The cartridge 7 is inserted into the corresponding cartridge mounting section 22 of the main apparatus body 100A and is positionally set at a predetermined image formable position. In this positioned state, the upper surface of the drum 1 comes into contact with the lower surface of the lower belt layer of the belt 5, whereby the primary transfer section T1 is formed. Furthermore, a drive output coupling (drive output section, not shown) of the main apparatus body 100A is coupled to the drive input coupling 46. Driving force is transmitted from the drive output coupling to the drive input coupling 46 so that the drum 1, the developing roller 42, the toner supplying roller 48, and the toner stirring member 61 are rotationally driven in predetermined rotational directions at predetermined speeds in accordance with the image forming operation. Furthermore, input electric contacts 84 (84*a*, 84*b*, 84*c*, and 84*d*) of the cartridge 7 shown in FIG. 3 are electrically connected to output electric contacts of the main apparatus body 100A. Predetermined bias is applied from the output electric contacts to the input electric contacts 84 so that predetermined charging bias and predetermined developing bias are applied to the charging roller 2 and the developing roller 42, respectively, in accordance with the image forming operation. The slit opening 63 serving as a laser-beam entrance opening corresponds to one of the laser exit windows 81 provided in the upper plate 80 of the laser scanner unit 3. Each laser beam L (La, Lb, Lc, or Ld) output from the laser scanner unit 3 enters the corresponding cartridge 7 via the lower slit opening 63 so as to be radiated onto the lower surface of the drum 1.

Process Cartridge Replacing Method

In the image forming apparatus 100 according to the first embodiment, each cartridge 7 is replaced based on a front-access method by opening the front door 21 serving as an openable-closable member of the main apparatus body 100A, as shown in FIG. 2B. In order to allow for better front accessibility, the front door 21 is provided with a handle 21*a*.

A front frame 37 (see FIGS. 5A and 5B) serving as a framework for the main apparatus body 100A is provided with an opening through which the cartridges 7 are moved for attaching and detaching the cartridges 7. Specifically, the opening is provided for inserting the cartridges 7 into the cartridge mounting sections 22 in the main apparatus body 100A or for ejecting the cartridges 7 from the cartridge mounting sections 22.

The front door 21 of the main apparatus body 100A is provided in a movable manner between a closed position in which the front door 21 closes and covers the opening and an open position in which the front door 21 opens the opening.

Figure 5A:
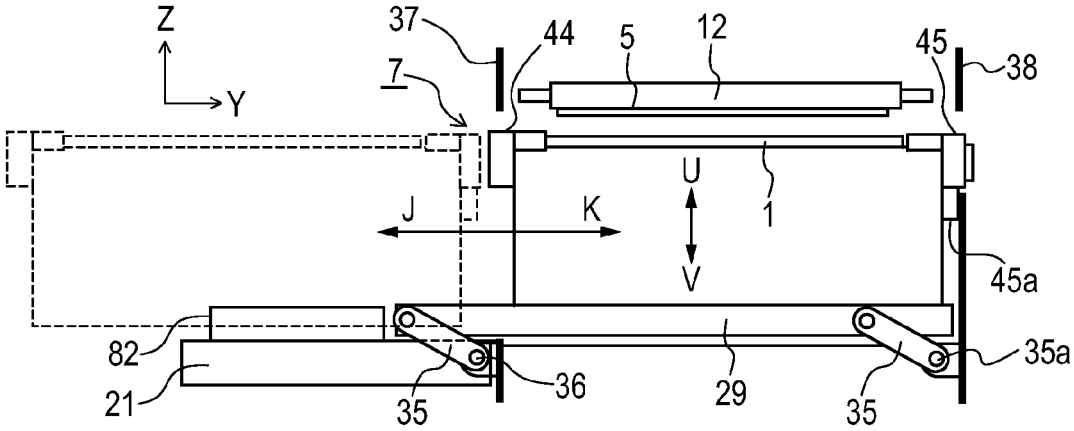
FIGS. 5A and 5B schematically illustrate a process-cartridge inserting process according to the first embodiment.
Figure 5B:
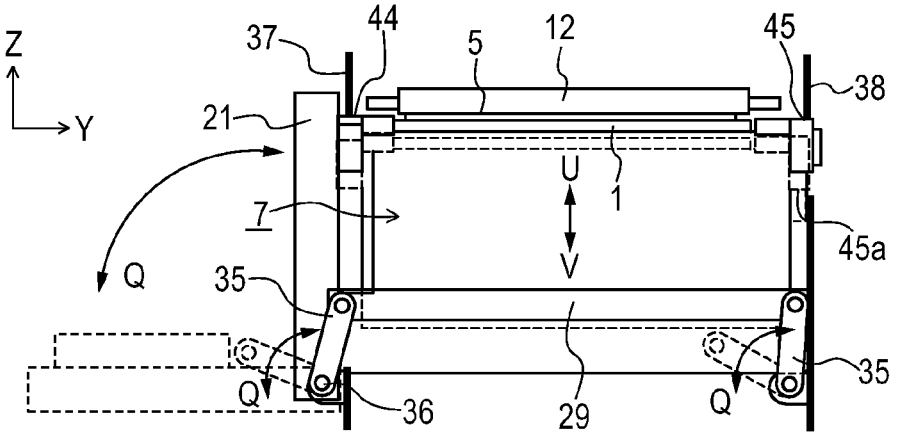

FIGS. 5A and 5B illustrate the operation performed when attaching and detaching each of the cartridges 7 to and from the main apparatus body 100A. FIG. 5A illustrates the operation performed when the cartridge 7 is attached to or detached from the main apparatus body 100A by sliding. FIG. 5B illustrates a state where the cartridge 7 is set in its image formable position by closing the front door 21.

When the front door 21 is opened by being rotated about a rotation shaft 36 as shown in FIG. 5B, first to fourth rotation arms 35 rotate in a direction indicated by an arrow Q in conjunction with the rotation of the rotation shaft 36. A cartridge rail 29 pivotally supported by and linked with the rotation arms 35 rotates to a position shown in FIG. 5A about the rotation shaft 36 and a rotation shaft 35*a* attached to a rear frame 38. Thus, each cartridge 7 in the main apparatus body 100A moves in a direction indicated by an arrow V from an image-formable positioned state (first state: FIG. 5B) to a non-positioned state (second state: FIG. 5A) in which the cartridge 7 is attachable to and detachable from the main apparatus body 100A. The conversion from the first state to the second state is achieved by moving the cartridge 7 downward to a predetermined position. In this case, the drums 1 of all of the first to fourth cartridges 7 (7*a*, 7*b*, 7*c*, and 7*d*) are separated from the belt 5, as shown in FIG. 1B.

Subsequently, a cartridge 7 to be replaced is pulled forward in a direction indicated by an arrow J.

While sliding the guide rib 43*b* at the lower section of the cleaning frame 43 continuously from a guide groove 29*g* (FIG. 2B) in the corresponding cartridge rail 29 (29*a* to 29*d*) to the corresponding guide groove 82 (82*a* to 82*d*) in the front door 21, the cartridge 7 is ejected outside the main apparatus body 100A. In this case, the upper section of the cartridge 7 is guided by an upper rail 34 (see FIG. 4).

Then, a new cartridge 7 is inserted into the main apparatus body 100A through the opening. The guide rib 43*b* at the lower section of the cleaning frame 43 is brought into engagement with the corresponding guide groove 82 in the front door 21, and an upper guide rib 43*c* is guided to the corresponding upper rail 34 (see FIG. 4). The cartridge 7 is pressed in the rearward direction indicated by an arrow K continuously along the cartridge rail 29 until a stopper 45*a* (see FIGS. 5A and 5B) attached to the shaft bearing 45 at the rear side of the cartridge 7 abuts on the rear frame 38. After all cartridges 7 to be replaced are replaced with new ones, the front door 21 is closed. By closing the front door 21, the rotation arms 35 rotate so that the cartridges 7 set in the cartridge mounting sections 22 within the main apparatus body 100A are moved in a direction indicated by an arrow U, whereby the cartridges 7 are set in the image-formable positioned state (first state: FIG. 5B) from the non-positioned state (second state: FIG. 5A) in which the cartridges 7 are attachable to and detachable from the main apparatus body 100A. The conversion from the second state to the first state is achieved by moving the cartridges 7 upward to predetermined positions. In this case, each cartridge 7 is set in position by applying pressure to a positioning section between the front frame 37 and the rear frame 38 via a pressure follower 40 by using a cartridge pressure spring 39 provided within the cartridge rail 29 shown in FIG. 4.

Since the cartridges 7 become attachable and detachable by moving them away from their image formable positions, the cartridges 7 can be inserted into the main apparatus body 100A without damaging main process components, such as adjoining transfer units and photosensitive drums. In other words, the user can replace the cartridges 7 with a simple manipulation without damaging the drums 1 and the belt 5 as much as possible.

In the present disclosure, a process for connecting a memory substrate of each cartridge 7 to electric contacts of the main apparatus body 100A is performed simultaneously with the process described above for sliding the cartridge 7 along the cartridge rail 29 to bring the cartridge 7 into abutment with the rear frame 38. A detailed description will be provided later.

Configuration of Cartridge Memory Substrate and Electric Contacts

Each cartridge 7 according to the first embodiment is provided with a memory 200 that stores information, such as the lot number of the cartridge 7, the characteristics of the image forming apparatus 100, and the characteristics of the process units. Needless to say, after image forming operation is performed by using the cartridge 7, the memory 200 may receive information, such as the number of rotations of an image bearing member and the lot number of the main apparatus body 100A, from the main apparatus body 100A and store the information.

Figure 6A:
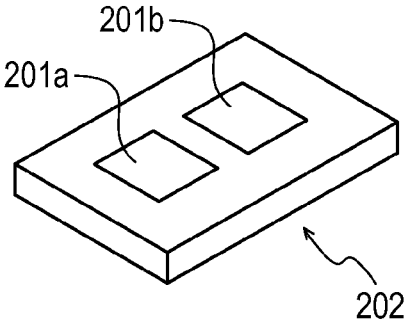
FIGS. 6A and 6B are perspective views of a memory substrate according to the first embodiment.
Figure 6B:
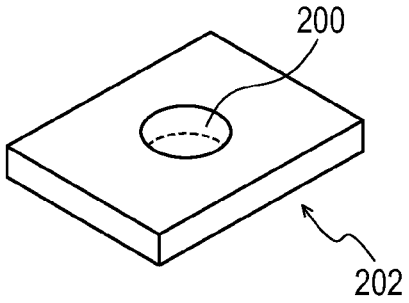

Next, the memory 200 will be described with reference to FIGS. 6A and 6B. FIGS. 6A and 6B are perspective views illustrating the memory 200 as a single component. Specifically, FIG. 6A is a perspective view illustrating a state where an electric-contact surface of a memory substrate faces upward, and FIG. 6B is a perspective view illustrating a state where a memory surface faces upward.

Each cartridge 7 according to the first embodiment exchanges information stored in the memory 200 with the main apparatus body 100A so as to notify the control circuit A provided in the main apparatus body 100A of the status, such as the usage condition, of the cartridge 7. Then, image forming operation is controlled in accordance with the information so that the image forming operation can be performed under better conditions. Although the memory 200 and the main apparatus body 100A are configured to exchange information, the main apparatus body 100A may be configured to unilaterally receive information from the memory 200.

Referring to FIG. 6B, the memory 200 according to the first embodiment is attached to a first surface of a memory substrate 202. Referring to FIG. 6A, the memory substrate 202 is a rectangular plate component and has a pair of cartridge electric-contacts 201*a* and 201*b* at a second surface of the memory substrate 202. The memory substrate 202 is attached to the cleaning frame 43 such that the cartridge electric-contacts 201*a* and 201*b* face outward. In the first embodiment, the cartridge electric-contacts 201*a* and 201*b* are disposed so as to face the rear side of the cartridge 7 as viewed in the inserting direction thereof, as shown in FIG. 3. Alternatively, the cartridge electric-contacts 201*a* and 201*b* may be provided at the front side (i.e., upstream side) or at the upper surface of the cartridge 7, depending on the shape of the cartridge 7.

Next, an apparatus electric-contact supporter, that is, a connector, for supporting apparatus electric-contacts 104*a* and 104*b* in the main apparatus body 100A will be described below.

Figure 7A:
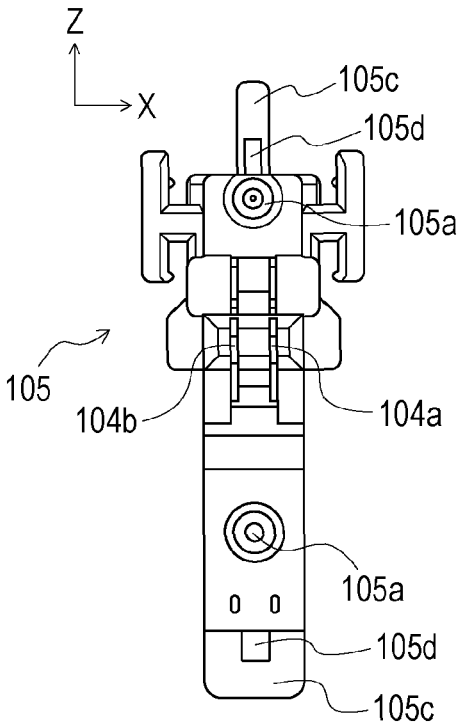
FIGS. 7A and 7B are external views of a connector (contact connector) according to the first embodiment.
Figure 7B:
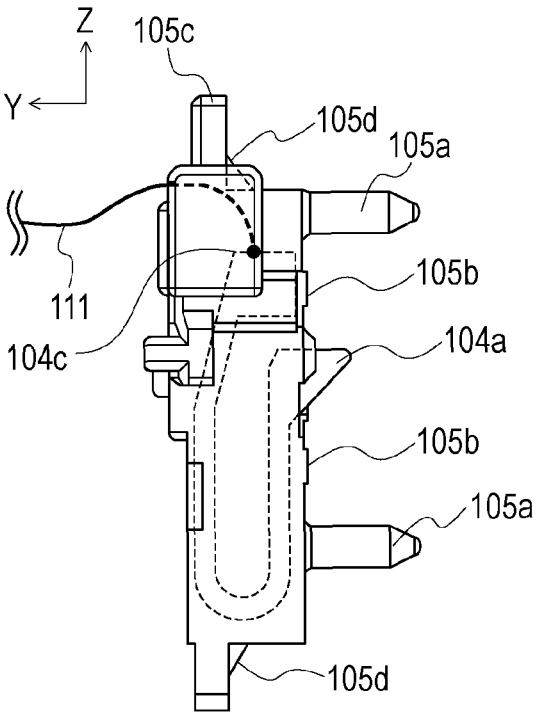

FIGS. 7A and 7B illustrate the configuration of a connector 105. The connector 105 has fixed thereto first ends 104*c* of the apparatus electric-contacts 104 (104*a* and 104*b*). Furthermore, the first ends 104*c* of the apparatus electric-contacts 104 have connector cables 111 fixed thereto. Information from the memory 200 is transmitted as an electrical signal through the connector cables 111 via the cartridge electric-contacts 201 and the apparatus electric-contacts 104 so as to be sent to the control circuit A of the main apparatus body 100A.

The apparatus electric-contacts 104 curve into a U-shape within the connector 105 and elastically deform in a Y direction when the cartridge 7 and a connector abutment section 105*b* come into contact with each other. Thus, contact pressure is applied toward the cartridge electric-contacts 201.

Figure 8A:
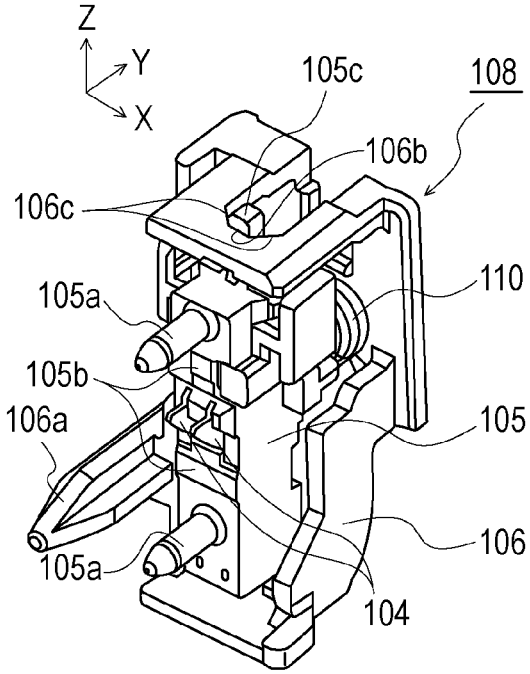
FIGS. 8A and 8B are external perspective views of a connector holding unit according to the first embodiment.
Figure 8B:
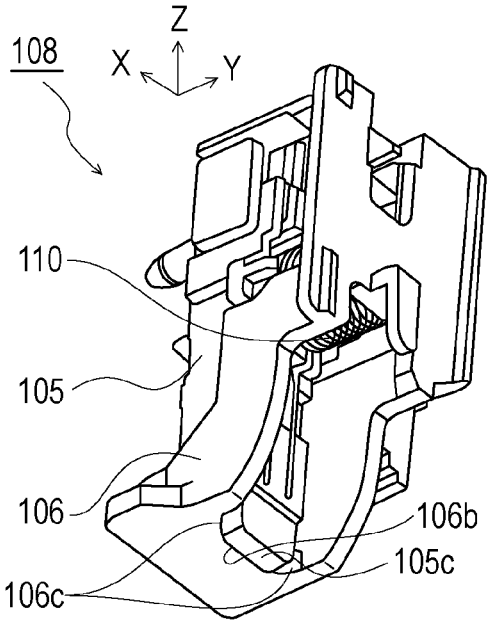

Next, a connector holding unit 108 that integrally holds the connector 105 will be described. Referring to FIGS. 8A and 8B, the connector 105 that supports the apparatus electric-contacts 104*a* and 104*b* and a connector holder 106 that holds the connector 105 constitute a connector holding unit 108 that integrally holds the connector 105 by using a connector pressure spring (pressing unit) 110 that presses the connector 105 toward the cartridge 7.

When connector engagement bosses 105*a*, serving as a first engaging unit, of the connector 105 engage with the cartridge 7, the cartridge electric-contacts 201 and the apparatus electric-contacts 104 are positioned relative to each other in X-Z directions. Specifically, the first engaging unit positions the electric contacts in any direction (including X direction and Z direction) in an X-Z plane. Moreover, when the cartridge 7 is slid and inserted into the main apparatus body 100A, an abutment surface 205 at a surface 43*d* at the rear side (i.e., drive side) of the cleaning frame 43 of the cartridge 7 comes into contact with the connector abutment section 105*b* of the connector 105 and presses the connector 105 downward until the stopper 45*a* of the cartridge 7 abuts on the rear frame 38 in the Y direction. Thus, the connector pressure spring 110 disposed between the connector holder 106 and the connector 105 bends, so that a certain abutment reactive force is applied to the cartridge 7. In this case, the abutment reactive force of the connector pressure spring 110 is set to be larger than the aforementioned contact pressure generated when the apparatus electric-contacts 104 bend.

Accordingly, the connector 105 has a predetermined degree of freedom in the X-Z directions due to the connector holder 106 and the connector pressure spring 110, and is also held in a movable manner in the Y direction.

When the connector holding unit 108 is not engaged with the cartridge 7, connector ribs (protrusions) 105*c* provided at opposite ends of the connector 105 in the Z direction thereof are engaged with connector engagement recesses 106*b* of the connector holder 106, as shown in FIGS. 8A and 8B. Opposite ends of each connector engagement recess 106*b* of the connector holder 106 are provided with tapered sections 106*c* that guide the corresponding connector rib (protrusion) 105*c* into engagement with the connector engagement recess 106*b*. Thus, when the connector 105 is not engaged with the cartridge 7, the connector 105 is set on standby at an intermediate position within the connector holder 106 in the X direction. Although the connector 105 is set on standby at the intermediate position in the first embodiment because each connector engagement recess 106*b* is located at an intermediate position, a configuration in which the position of each connector engagement recess 106*b* is displaced from the intermediate position and the connector 105 is set on standby at that position is also possible. Furthermore, the connector 105 also has tapered sections 105*d* and is set on standby at an intermediate position within the connector holder 106 in the Z direction, as shown in FIGS. 7A and 7B. In this case, the position of each tapered section 105*d* may be changed so that the standby position can be set at a position displaced from the intermediate position. Accordingly, since the position of the connector 105 is defined to a certain extent, a tapered guiding area used when engaging the connector engagement bosses 105*a* with engagement recesses 203 in the cartridge 7 can be reduced. Furthermore, since the moving distance for guiding the connector 105 into engagement with the cartridge 7 can be minimized, the occurrence of operational failures during the engagement process can be reduced, thereby allowing for enhanced operational reliability.

Next, the connection configuration between the cartridge electric-contacts 201*a* and 201*b* of the memory 200 provided in the cartridge 7 and the apparatus electric-contacts 104*a* and 104*b* provided in the main apparatus body 100A will be described with reference to FIG. 9.

Figure 9:
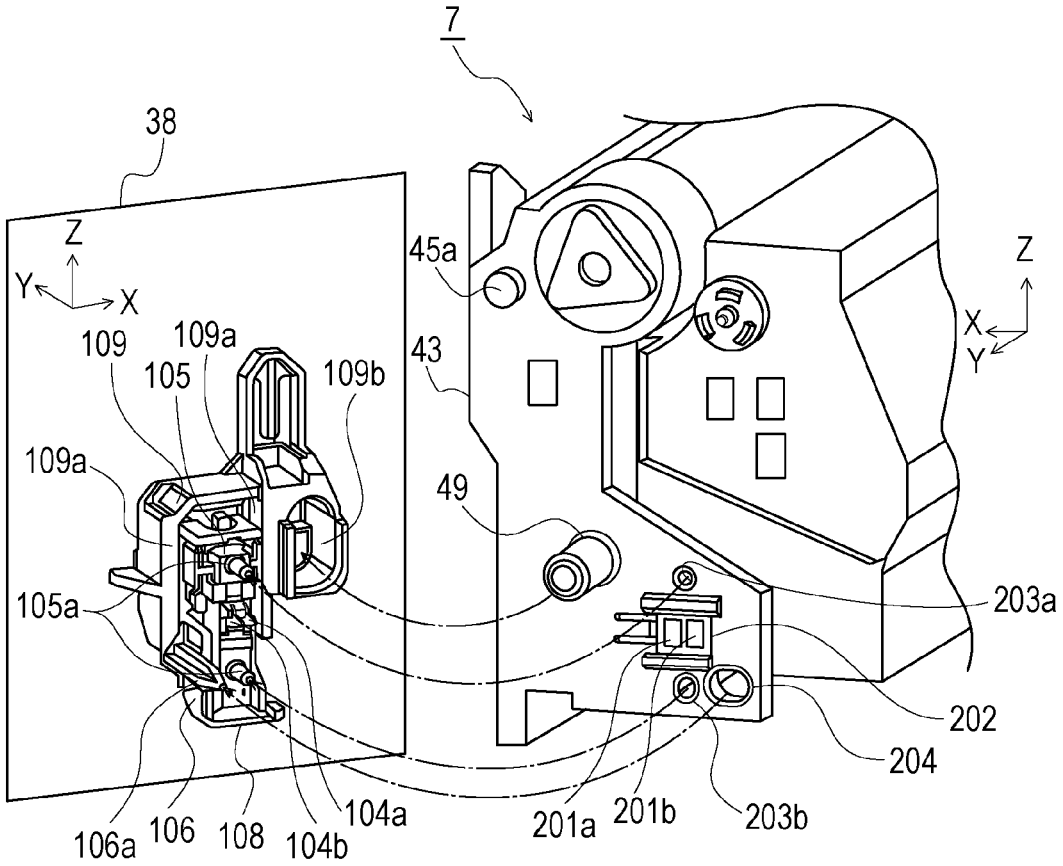
FIG. 9 is an external perspective view illustrating the process cartridge and apparatus electric-contacts, in accordance with the first embodiment.

FIG. 9 is a perspective view illustrating an electric-contact area between the main apparatus body 100A and the memory substrate 202 of each cartridge 7. The rear surface (i.e., drive-side surface) of the cartridge 7 is provided with the memory substrate 202 and the engagement recesses 203 (203*a* and 203*b*) serving as a first engagement unit near the memory substrate 202. When the cartridge 7 is slid and inserted into the main apparatus body 100A, the engagement recesses 203 serve as an engagement unit that positions the connector 105 relative to the cartridge 7. Moreover, the rear surface is also provided with a cartridge positioning boss 49 for positioning the cartridge 7 and a cartridge slot 204 for engaging the cartridge 7 with the connector holder 106.

In the main apparatus body 100A, the connector holding unit 108 integrally holds the connector 105 and is slidably supported by and attached to the rear frame 38 of the main apparatus body 100A in a movable manner only in the Z direction along a guide rail 109*a* of a slide guide 109. Furthermore, the slide guide 109 has an elongated recess 109*b* that is engageable with the cartridge positioning boss 49 and that extends parallel to the Z direction.

Next, the operation for inserting the cartridge 7 into the main apparatus body 100A and the operation for positioning an electric-contact mechanism will be described.

When the cartridge 7 is slid and inserted in the Y direction, the cartridge positioning boss 49 is first brought into engagement with the elongated recess 109*b* of the slide guide 109. Thus, the cartridge 7 is positioned in the X direction.

Subsequently, a connector-holder engagement boss 106*a* serving as a second engaging unit of the connector holder 106 engages with the cartridge slot 204 serving as a second engagement unit. Thus, the connector holder 106 and the cartridge 7 are positioned in the Z direction.

Then, the connector engagement bosses 105*a* serving as the first engaging unit of the connector 105 engage with the engagement recesses 203 serving as the first engagement unit, whereby the connector 105 and the cartridge 7 are positioned in the X-Z directions.

Finally, in the state where the abutment surface 205 of the cartridge 7 and the connector abutment section 105*b* of the connector 105 are in abutment with each other, the connector 105 is pressed downward until the stopper 45*a* abuts on the rear frame 38. In this abutted state, the connector 105 and the cartridge 7 are positioned in the Y direction. With this configuration, the contact area of the cartridge electric-contacts 201 in the memory substrate 202 can be set to a minimum size relative to the contact area of the apparatus electric-contacts 104.

Furthermore, the tapered area for guiding the engaging units, such as the engagement recesses and the positioning bosses of the connector holder 106, can be minimized, whereby a compact connector holder 106 can be formed. In addition, since the movable range in which the connector holding unit 108 holds the connector holder 106 in a movable manner with a certain degree of freedom can be reduced, compactness can be achieved.

Figure 10A:
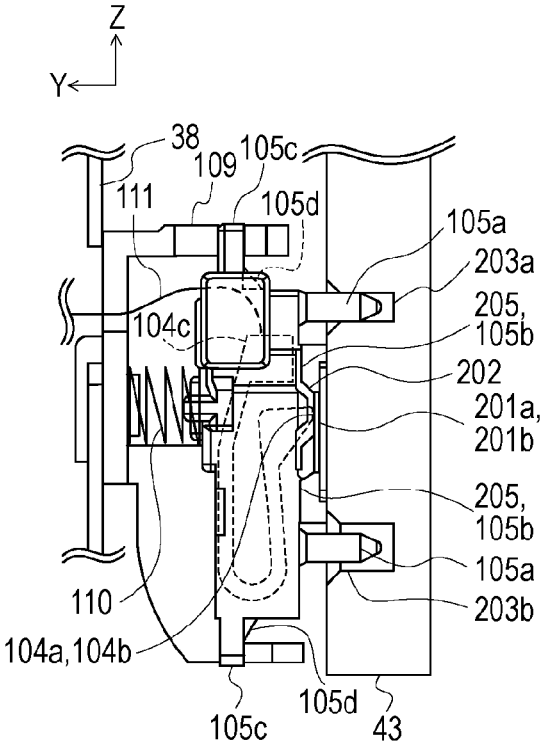
FIGS. 10A and 10B are sectional views illustrating an engaged state between the cartridge and the apparatus electric-contacts, in accordance with the first embodiment.

FIG. 10A is a sectional view illustrating a contact state between the connector 105 and the cartridge electric-contacts 201 when the cartridge 7 is slid and inserted into abutment with the rear frame 38 of the main apparatus body 100A.

As shown in FIG. 10A, the connector 105 is brought into abutment with the cleaning frame 43 of the cartridge 7 with the pressing force from the connector pressure spring 110 so that the apparatus electric-contacts 104 supported by the connector 105 and the cartridge electric-contacts 201 of the cartridge 7 are electrically connected to each other with a stable contact pressure. Accordingly, the connector 105 conforms to the longitudinal end of the cartridge 7 so that variations in the contact pressure of the apparatus electric-contacts 104 relative to the cartridge electric-contacts 201 in the memory substrate 202 are reduced. In other words, with a predetermined pressing force, stable connection between the cartridge electric-contacts 201 and the apparatus electric-contacts 104 can be ensured.

As described above, after sliding and inserting the cartridge 7 into the main apparatus body 100A in the Y direction, the cartridge 7 needs to be moved in the Z direction by closing the front door 21 so that the cartridge 7 is positionally set in its image-formable positioned state (i.e., the first state: FIG. 5B). In the first embodiment, in the state where the cartridge electric-contacts 201 and the apparatus electric-contacts 104 are connected to each other, the connector 105 that supports the apparatus electric-contacts 104 and the connector holder 106 are integrally moved so that the cartridge 7 is positioned relative to the main apparatus body 100A.

Figure 10B:
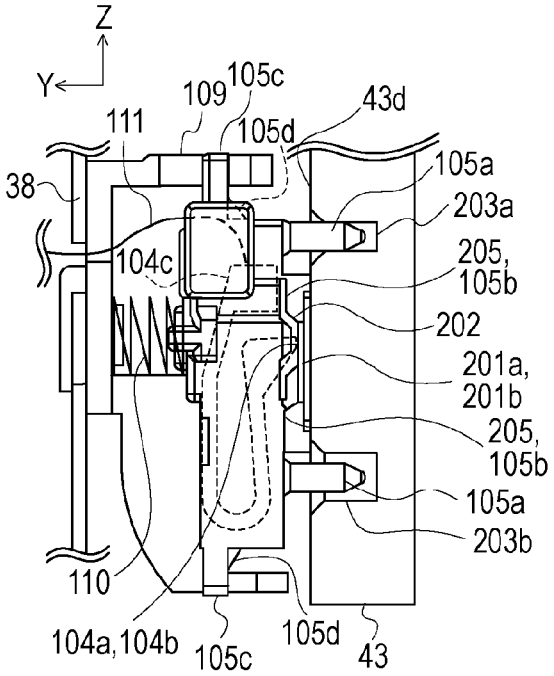

FIG. 10B is a sectional view of the cartridge 7 and an apparatus electric-contact mechanism, which follows the vertical movement of the cartridge 7.

As shown in FIG. 10B, the connector 105 and the connector holder 106 that are engaged with the cartridge 7 are integrally moved in the Z direction relative to the rear frame 38 of the main apparatus body 100A. A movement guide is provided for moving the connector 105 and the connector holder 106 in the Z direction. The movement guide is L-shaped and has a guide section guides the plate of the rear frame 38 of the main apparatus body 100A. In the image-formable positioned state (i.e., first state: FIG. 10B), an edge of the plate of the rear frame 38 and an edge of the movement guide are positioned close to each other. In the non-positioned state (second state: FIG. 10A), the plate enters the guide section while being guided by the guide section.

Thus, sliding load of the connector holder 106 in accordance with this upward movement is applied to the connector holder 106, whereas the sliding load of the vertical movement is hardly applied to the connector 105, whereby a stable contact state can be ensured.

Furthermore, even when the cartridge 7 becomes significantly displaced due to an impact during physical distribution, etc. caused by the connector 105 and the connector holder 106 separately engaging with the cartridge 7, since the connector 105 is movable in a predetermined direction within the connector holder 106, the connector 105 moves and compensates for the displacement. Thus, even if the first engaging unit is a compact engaging section with low rigidity, the occurrence of large external force acting thereon can be reduced, whereby more stable connection between the cartridge electric-contacts 201 and the apparatus electric-contacts 104 can be ensured, as compared with the related art.

The connector 105 may be movable in a linear direction extending through the X-Z plane. However, in view of an impact occurring when the main apparatus body 100A is dropped, supposing that the force acting in the movable direction is separated into a force component acting in the gravitational direction and a force component acting in the horizontal direction, the force component acting in the gravitational direction needs to be larger than the force component acting in the horizontal direction.

Although the movable direction is preferably the gravitational direction, the movable direction may be slightly deviated from the gravitation direction because the cartridge 7 may sometimes be set diagonally. However, if the aforementioned force components are to be taken into account, it is preferable that the force component acting in the gravitational direction be the larger.

When the cartridge 7 is to be detached from the main apparatus body 100A, the cartridge 7 is disengaged therefrom by performing the above-described process in the reversed order.

The cartridge electric-contacts 201*a* and 201*b* are plated with gold for achieving reliable electric connection. Thus, the reliability of the electric connection is improved. Specifically, the apparatus electric-contacts 104*a* and 104*b* and the cartridge electric-contacts 201*a* and 201*b* in the first embodiment are composed of gold-plated copper. With this configuration, the usage of copper and gold plating, which are expensive, can be reduced as much as possible.

Second Embodiment

An image forming apparatus according to a second embodiment will now be described with reference to FIGS. 11A and 11B. In the configuration of the second embodiment, components that are the same as those in the first embodiment are given the same reference characters, and detailed descriptions thereof will be omitted.

Figure 11A:
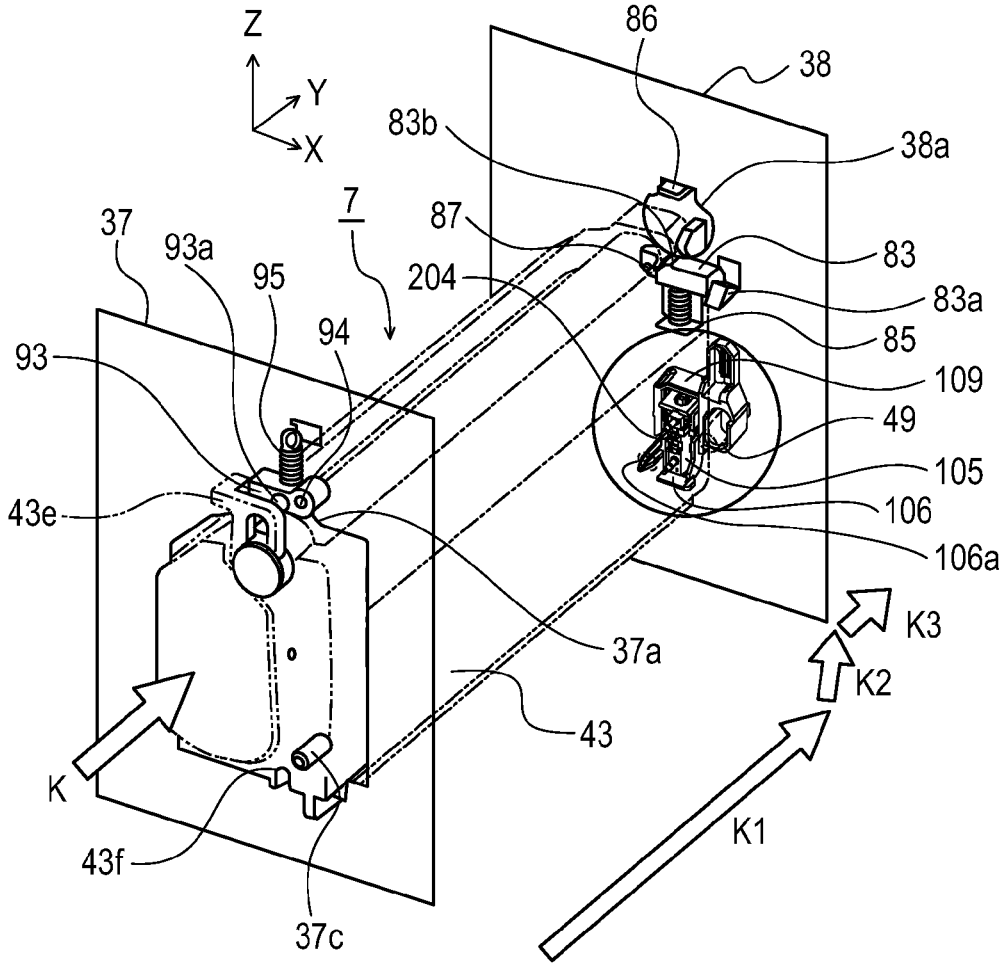
FIGS. 11A and 11B illustrate a cartridge and a main apparatus body according to a second embodiment.
Figure 11B:
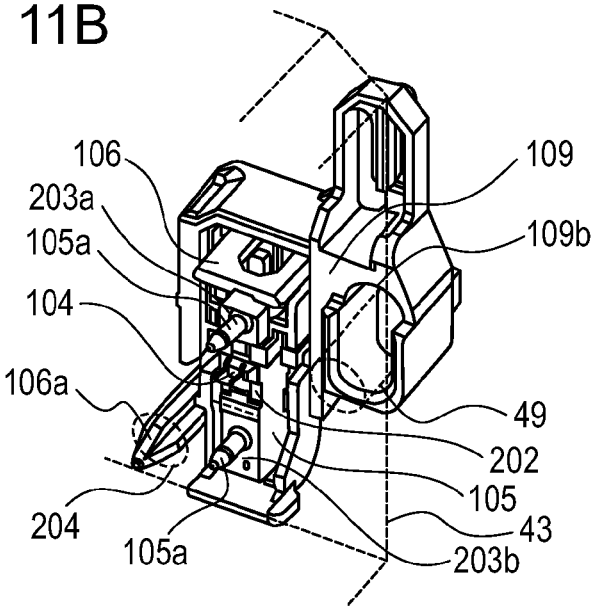

FIG. 11A is a perspective view of a process-cartridge mounting section in the image forming apparatus according to the second embodiment. FIG. 11B is an enlarged perspective view of electric contacts in the memory substrate 202 in FIG. 11A and a surrounding area thereof.

Specifically, the method of how each process cartridge 7 serving as an image forming section is inserted into the main apparatus body 100A in the second embodiment is different from that in the first embodiment. The memory and memory contacts disposed in the cartridge 7 and the apparatus electric-contacts 104 are substantially the same as those in the first embodiment.

In FIG. 11A, the front frame 37 and the rear frame 38 of the main apparatus body 100A are provided with stoppers 37*a* and 38*a* for positioning the cartridge 7, and a cartridge lifting member 93 and a cartridge pressing member 83 for pressing the cartridge 7. With regard to the cartridge lifting member 93 of the front frame 37, lifting force is applied in the Z direction about a rotation shaft 94 by a lifting spring 95 so that a pin 93*a* is brought into engagement with an engaging section 43*e* of the cartridge 7, whereby the cartridge 7 is lifted. The pin 93*a* has a tapered end such that the engaging section 43*e* of the cartridge 7 engages with the pin 93*a* by moving along the tapered end. With regard to the cartridge pressing member 83 of the rear frame 38, lifting force is applied in the Z direction about a rotation shaft 87 by a pressing spring 85 so that a part of the cartridge 7 is made to slide on a sloped surface 83*a*, whereby the cartridge 7 is moved upward. Subsequently, the cartridge 7 is pressed against the stopper 38*a* of the rear frame 38 by a pressing section 83*b* of the cartridge pressing member 83.

In this configuration, when the cartridge 7 is slid and inserted in a direction indicated by an arrow K, the cartridge 7 slides along an arrow K1. As the cartridge 7 approaches the rearmost position, the cartridge 7 is lifted upward in a direction indicated by an arrow K2 along the tapered end of the pin 93*a* of the cartridge lifting member 93 and the sloped surface 83*a* of the cartridge pressing member 83. Finally, in a state where the stopper 45*a* of the cartridge 7 is in abutment with the stopper 38*a* of the rear frame 38, the cartridge 7 is inserted in a direction indicated by an arrow K3 until the cartridge 7 abuts on the rear frame 38. At the front side of the cartridge 7, a recess 43*f* engages with a frame boss 37*c*.

With this simple configuration, the cartridge 7 can be reliably set in the positioned state, and the cartridge replacement process can be performed by the user without damaging the transfer belt 5 and the photosensitive drum 1.

An engagement process between the cartridge 7 and the apparatus electric-contact mechanism when performing the above operation will be described below with reference to FIG. 11B.

In the inserting process of the cartridge 7 described above, the cartridge positioning boss 49 comes into engagement with the elongated recess 109*b* in the slide guide 109 when the cartridge 7 is slid and inserted along the arrow K1. Then, the connector-holder engagement boss 106*a* of the connector holder 106 and the cartridge slot 204 in the cartridge 7 come into engagement with each other.

Subsequently, when the cartridge 7 is moved diagonally upward in the direction of the arrow K2 along the sloped surface 83*a* of the cartridge pressing member 83, the connector holding unit 108 that integrally holds the connector 105 with the connector holder 106 also moves upward in the Z direction. At the same time, the connector engagement bosses 105*a* of the connector 105 engage with the engagement recesses 203 in the cartridge 7. Moreover, the cartridge positioning boss 49 slides upward within the elongated recess 109*b* in the slide guide 109.

Finally, before the cartridge 7 moves in the direction of the arrow K3 and abuts on the rear frame 38, the connector abutment section 105*b* of the connector 105 and the abutment surface 205 of the cartridge 7 come into abutment with each other. In this case, a bending amount of the apparatus electric-contacts 104 supported by the connector 105 is ensured so that desired contact pressure is applied to the contacts.

In the above-described configuration, advantages similar to those in the first embodiment are achieved. In addition, in a series of successive cartridge inserting steps as in the second embodiment, the connector 105 can positionally follow the upward movement of the cartridge 7, thereby allowing for stable engagement between the cartridge 7 and the connector 105. Furthermore, a highly-reliable contact mechanism that electrically connects the memory substrate 202 of the cartridge 7 to the apparatus electric-contacts 104 can be provided.

Third Embodiment

By further reducing the sizes of the memory substrate, the electric contacts therein, and the apparatus electric-contacts, it is conceivable to achieve cost reduction as well as size reduction of the main apparatus body and each cartridge. In order to reduce the size of the memory substrate, a configuration shown in FIG. 12 is permissible.

Figure 12:
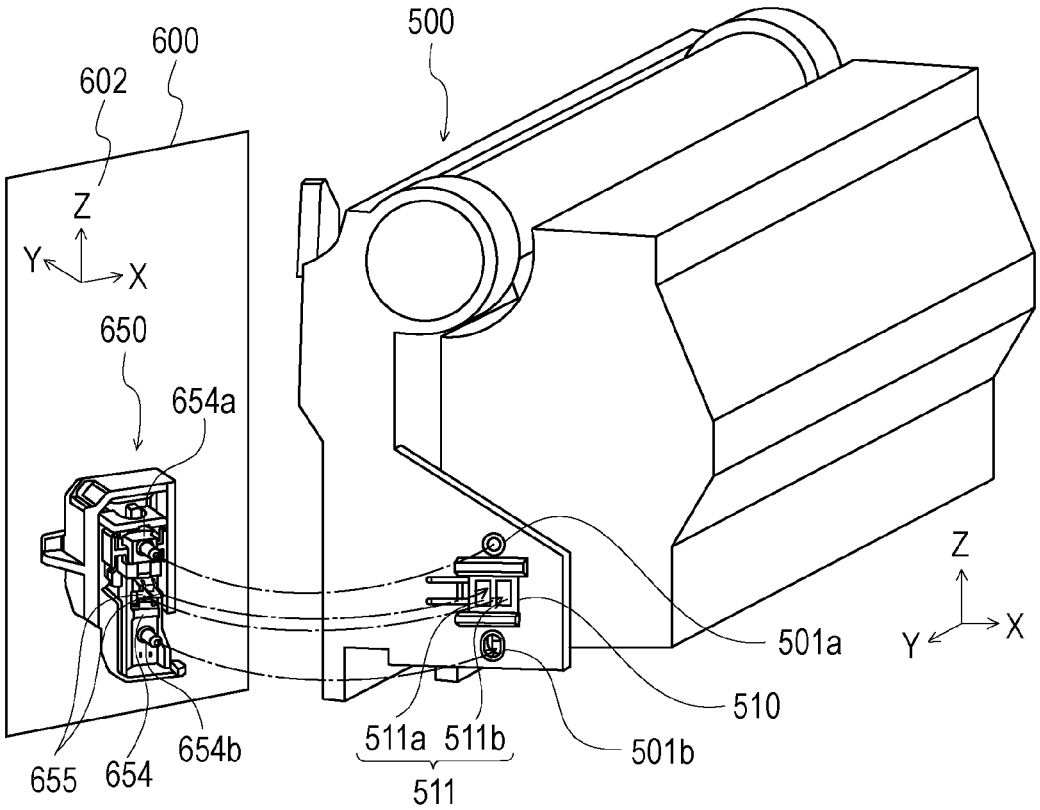
FIG. 12 is a perspective view illustrating a memory in a process cartridge and an apparatus electric-contact according to a third embodiment.

As shown in FIG. 12, when inserting a cartridge 500 into a main apparatus body 600, engagement holes 501 (501*a* and 501*b*) serving as a first engagement unit of the cartridge 500 are brought into engagement with bosses 654*a* and 654*b* serving as a first engaging unit of a connector 654 of a connector holding unit 650 attached to the main apparatus body 600, thereby electrically connecting cartridge electric-contacts 511 (511*a* and 511*b*) of a memory substrate 510 to the apparatus electric-contacts.

Figure 13A:
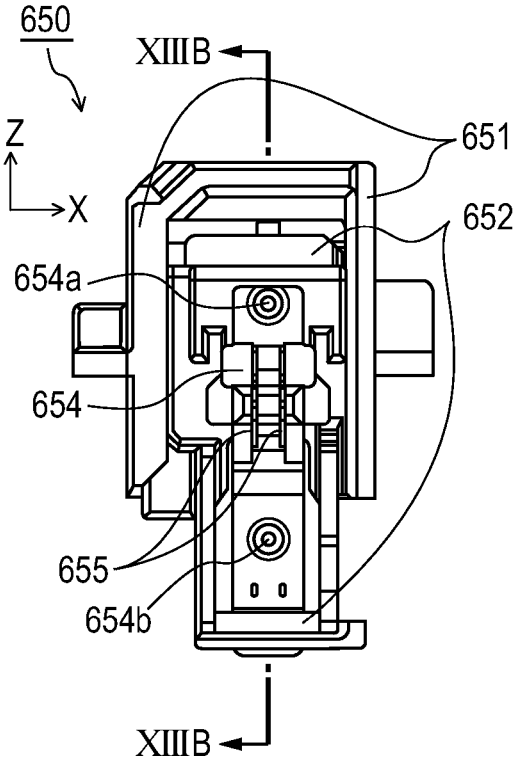
FIGS. 13A and 13B are a front view and a sectional view, respectively, of the apparatus electric-contact according to the third embodiment.
Figure 13B:
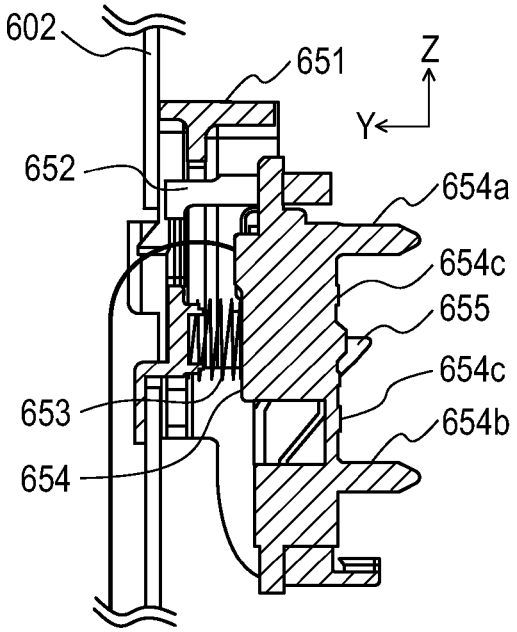

FIGS. 13A and 13B illustrate the configuration of the connector holding unit 650 attached to the main apparatus body 600. Specifically, FIG. 13B is a sectional view taken along line XIIIB-XIIIB in FIG. 13A.

In the connector holding unit 650, a slide guide 651 is attached to an apparatus rear plate 602, and a connector holder 652 is immovable in the X direction and the Y direction while being held slidably in the Z direction. The connector holder 652 holds the connector 654, which supports an apparatus electric-contact spring 655, in an immovable manner in the Z direction and in a slidable manner in the X direction. The connector 654 is slidably supported by the slide guide 651 and the connector holder 652 so that positional variations, including component tolerance between the connector 654 and the cartridge 500 in the X-Y directions, can be compensated for during an engagement process.

In order to bring abutment sections 654*c* of the connector 654 into abutment with the cartridge 500, the connector holder 652 holds a pressing member 653 that applies a pressing force that is higher than the contact pressure of the apparatus electric-contact spring 655. The connector 654 has the bosses 654*a* and 654*b* (first engaging unit) used for the positioning relative to the cartridge 500. The positioning bosses 654*a* and 654*b* engage with the engagement holes 501 (501*a* and 501*b*) in the cartridge 500 so that the number of components interposed between the cartridge electric-contacts 511 on the memory substrate 510 and the apparatus electric-contact spring 655 supported by the connector 654 is minimized, thereby minimizing positional variations at the electric contacts. Accordingly, the installation area of the cartridge electric-contacts 511 composed of copper and gold plating on the memory substrate 510 can be minimized, thus achieving minimal size and cost reduction of the memory substrate 510. This also allows for compactness of the connector 654.

Since the connector holder 652 does not need to have a second engaging unit in the third embodiment, the connector holding unit 650 can be made smaller than those in the first and second embodiments.

With regard to the configuration for inserting the cartridge 500 into the main apparatus body 600, the cartridge 500 is set in its image formable position by being moved vertically after it is inserted into the main apparatus body 600. In this configuration, since the connector holding unit 650 does not have a second engaging unit, the connector holding unit 650 needs to receive force when the cartridge 500 is moved vertically in response to the movement of the connector 654 in a predetermined direction. Thus, it is assumed that large force is applied to the first engaging unit.

Other Embodiments

In the above-described embodiments, a color electrophotographic image forming apparatus of a contact development type and cartridges have been described as an example. Alternatively, the present invention is applicable to a monochrome electrophotographic image forming apparatus or an image forming apparatus of a non-contact development type, or to a developing unit mountable into a main apparatus body and to a developer unit having a developer.

Furthermore, in the above-described embodiments, each cartridge has a photosensitive drum and at least one process unit. Examples of a process unit include a charging unit, a developing unit, and a cleaning unit. Alternatively, the present invention is applicable to any kind of a cartridge equipped with a memory. Therefore, a cartridge may be formed by combining a charging unit, a developing unit, or a cleaning unit with a photosensitive drum, and this cartridge may be configured to be attachable to and detachable from the main apparatus body. Furthermore, a cartridge may be formed by combining at least one of a charging unit, a developing unit, or a cleaning unit with a photosensitive drum, and this cartridge may be configured to be attachable to and detachable from the main apparatus body. Moreover, a cartridge may be formed by combining at least a developing unit with a photosensitive drum, and this cartridge may be configured to be attachable to and detachable from the main apparatus body.

Furthermore, the term "cartridge" includes a toner cartridge that is attachable to and detachable from the main apparatus body and that serves as a container filled with a toner and independent from the aforementioned process units and the photosensitive drum.

An electrophotographic image forming apparatus is configured to form an image onto a recording medium by using an electrophotographic image forming method. Examples of an electrophotographic image forming apparatus include an electrophotographic copier, an electrophotographic printer (e.g., a laser beam printer or a light-emitting-diode (LED) printer), a facsimile apparatus, and a word processor.

Although each cartridge is configured to be moved toward an image formable position after being slid and inserted into the main apparatus body in the above description of the first and second embodiments, the inserting method is not limited to those described above.

According to the present invention, stable connection between the electric contacts of each cartridge and the electric contacts of the main apparatus body can be ensured even when a strong impact is applied thereto during physical distribution or when the cartridge is operated by the user.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-272620 filed Dec. 13, 2012, which is hereby incorporated by reference herein in its entirety.

What is claimed is:

1. An image forming apparatus comprising:

an apparatus electric-contact that is connectable to a cartridge electric-contact of a cartridge, which is equipped with a memory that stores information related to the cartridge such that the information is transmitted from the cartridge to a main apparatus body of the image forming apparatus;

a connector having the apparatus electric-contact and a first engaging unit that is engageable with the cartridge to position the cartridge electric-contact and the apparatus electric-contact in a predetermined direction; and a connector holder that holds the connector in a movable manner, wherein the connector holder has a second engaging unit that is engageable with the cartridge, and wherein the connector is movable in the predetermined direction in a state that the cartridge electric-contact contacts the apparatus electric-contact.

2. The image forming apparatus according to claim 1, wherein the connector is movable in the predetermined direction in a state where the first engaging unit and the cartridge are engaged with each other.

3. The image forming apparatus according to claim 1, wherein in a case where a force acting in the predetermined direction is separated into a force component acting in a gravitational direction and a force component acting in a horizontal direction, the predetermined direction is set such that the force component acting in the gravitational direction is greater than the force component acting in the horizontal direction.

4. The image forming apparatus according to claim 1, wherein the predetermined direction is a gravitational direction.

5. The image forming apparatus according to claim 1, wherein the cartridge is mounted in the main apparatus body in a detachable manner.

6. The image forming apparatus according to claim 1, further comprising a connector holding unit including the connector, a pressing unit that presses the connector to connect the apparatus electric-contact and the cartridge electric-contact to each other, and the connector holder.

7. The image forming apparatus according to claim 1, wherein when the cartridge is mounted to the main apparatus body, the apparatus electric-contact and the cartridge electric-contact are brought into contact with each other and are electrically connected to each other after the cartridge and the first engaging unit are engaged with each other.

8. The image forming apparatus according to claim 1, wherein when the cartridge is mounted to the main apparatus body, the apparatus electric-contact and the cartridge electric-contact are brought into contact with each other and are electrically connected to each other after the cartridge and the second engaging unit are engaged with each other.

9. The image forming apparatus according to claim 1, wherein the connector holder has a movement guide for moving the connector holder in conjunction with a closing of a door.

10. The image forming apparatus according to claim 1, wherein the connector has protrusions at opposite ends thereof in a predetermined direction.

11. The image forming apparatus according to claim 10, wherein the connector holder has recesses that engage with the protrusions.

12. An image forming apparatus comprising:

an apparatus electric-contact that is connectable to a cartridge electric-contact of a cartridge, which is equipped with a memory that stores information related to the cartridge such that the information is transmitted from the cartridge to a main apparatus body of the image forming apparatus;

a connector having the apparatus electric-contact and a first engaging unit that is engageable with the cartridge to position the cartridge electric-contact and the apparatus electric-contact in a predetermined direction; and a connector holder that holds the connector in a movable manner, wherein the connector holder has a second engaging unit that is engageable with the cartridge, wherein the connector is movable in the predetermined direction, and wherein in a case where a force acting in the predetermined direction is separated into a force component acting in a gravitational direction and a force component acting in a horizontal direction, the predetermined direction is set such that the force component acting in the gravitational direction is greater than the force component acting in the horizontal direction.

13. The image forming apparatus as claimed in claim 12, wherein the connector is movable in the predetermined direction in a state that the cartridge electric-contact contacts the apparatus electric-contact.

14. The image forming apparatus according to claim 12, wherein the connector is movable in the predetermined direction in a state where the first engaging unit and the cartridge are engaged with each other.

15. The image forming apparatus according to claim 12, wherein the cartridge is mounted in the main apparatus body in a detachable manner.

16. The image forming apparatus according to claim 12, further comprising a connector holding unit including the connector, a pressing unit that presses the connector to connect the apparatus electric-contact and the cartridge electric-contact to each other, and the connector holder.

17. The image forming apparatus according to claim 12, wherein when the cartridge is mounted to the main apparatus body, the apparatus electric-contact and the cartridge electric-contact are brought into contact with each other and are electrically connected to each other after the cartridge and the first engaging unit are engaged with each other.

18. The image forming apparatus according to claim 12, wherein when the cartridge is mounted to the main apparatus body, the apparatus electric-contact and the cartridge electric-contact are brought into contact with each other and are electrically connected to each other after the cartridge and the second engaging unit are engaged with each other.

19. The image forming apparatus according to claim 12, wherein the connector holder has a movement guide for moving the connector holder in conjunction with a closing of a door.

20. The image forming apparatus according to claim 12, wherein the connector has protrusions at opposite ends thereof in a predetermined direction.

21. The image forming apparatus according to claim 20, wherein the connector holder has recesses that engage with the protrusions.

* * * * *